United States Patent [19]

Ohman et al.

[11] 4,402,109

[45] Sep. 6, 1983

[54] TRAVERSE ROD AND PULLEY HOUSING ASSEMBLY

[75] Inventors: Thor Ohman; Mark J. Terlecke, both of Madison, Wis.

[73] Assignee: Graber Industries, Inc., Middleton, Wis.

[21] Appl. No.: 288,937

[22] Filed: Jul. 31, 1981

[51] Int. Cl.[3] ..... A47H 5/032

[52] U.S. Cl. ..... 16/95 D; 16/96 D; 16/97

[58] Field of Search ..... 160/345, 346; 16/87.8, 16/87.4 R, 87.4 W, 87.6 W, 87.6 R, 94 R, 94 D, 95 R, 95 D, 95 DW, 96 D, 97, 93 R, 93 D

[56] References Cited

U.S. PATENT DOCUMENTS 3,119,442 1/1964 Ford et al. .
3,333,622 8/1967 Graber .
3,470,578 10/1969 Graber et al. .
3,521,317 7/1970 Ford .
3,653,091 4/1972 McKenna .
3,713,473 1/1973 Ford .
3,951,195 4/1976 Salzmann ..... 16/94 D X

*Primary Examiner*—Mark Rosenbaum
*Attorney, Agent, or Firm*—Vernon J. Pillote

[57] ABSTRACT

A traverse rod and pulley housing assembly in which the pulley housings are dimensioned for insertion into the rod from the ends thereof and have a lower portion dimensioned to pass downwardly through a rod opening in the lower face wall of the rod. One set of ribs is provided on the pulley housing for laterally and vertically positioning the pulley housing in the inner rod member and a second set of ribs is provided in the pulley housing for laterally and vertically positioning the pulley housing in the outer rod member. Dual slide gates are provided, one on each side of the pulley housing, for controlling movement of the slides along the inner and outer rod members.

16 Claims, 7 Drawing Figures

TRAVERSE ROD AND PULLEY HOUSING ASSEMBLY

BACKGROUND OF THE INVENTION

In the cafe type traverse rods and decorative traverse rods designed to simulate the appearance of an old-fashioned ring pole, it is common practice to locate the pulley housings inwardly of the ends of the rod and to provide a cord opening in the lower face wall of the rod to allow the traverse cords to pass downwardly from the pulley housing. In U.S. Pat. Nos. 3,119,442; 3,333,622; 3,470,578 and 3,521,317, the pulley housings are inserted into the rod from the ends of the rod. However, the pulley housings in those patents are disposed wholly within the rod and the relatively sharp edges of the rod around the cord opening are exposed where they can be contacted by the cords and cause abrasion and wear. It has also been proposed as shown in U.S. Pat. Nos. 3,653,091 and 3,713,473, to insert the pulley housing laterally into openings in the face wall of the traverse rod. When the pulley housing is inserted upwardly through an opening in the bottom of the rod, there is a problem of adequately supporting the pulley housing against the downward pull exerted on the traverse cords. U.S. Pat. No. 3,713,473 discloses an arrangement in which the pulley housings are inserted downwardly through an opening in the top of the rod and are supported on the top of the rod to guide the cord through a cord opening in the bottom of the rod. The top opening adversely affects the appearance of the rod and supporting the pulley housing on the top of the rod tends to cause deformation of the rod and trackway, under the forces applied to the pulley housing by the draw cords.

SUMMARY OF THE INVENTION

It is the object of the present invention to overcome the disadvantages of the prior art by providing a traverse rod and pulley housing assembly in which the pulley housing is adapted to be inserted into the end of the rod and positioned and supported in the rod with the lower portion of the pulley housing extending downwardly through the cord opening in the bottom of the rod.

Another object of this invention is to provide a telescoping traverse rod and pulley housing assembly in which the same pulley housing can be used in both the inner and outer rod members and at either end of the traverse rod assembly.

Still another object of this invention is to provide a traverse rod and pulley housing assembly in which the pulley housing has an improved slide gate construction for controlling movement of the drapery carriers past the pulley housing.

These, together with other objects features and advantages of this invention will be more readily understood by reference to the following detailed description, when taken in connection with the accompanying drawings wherein.

Figure 1:
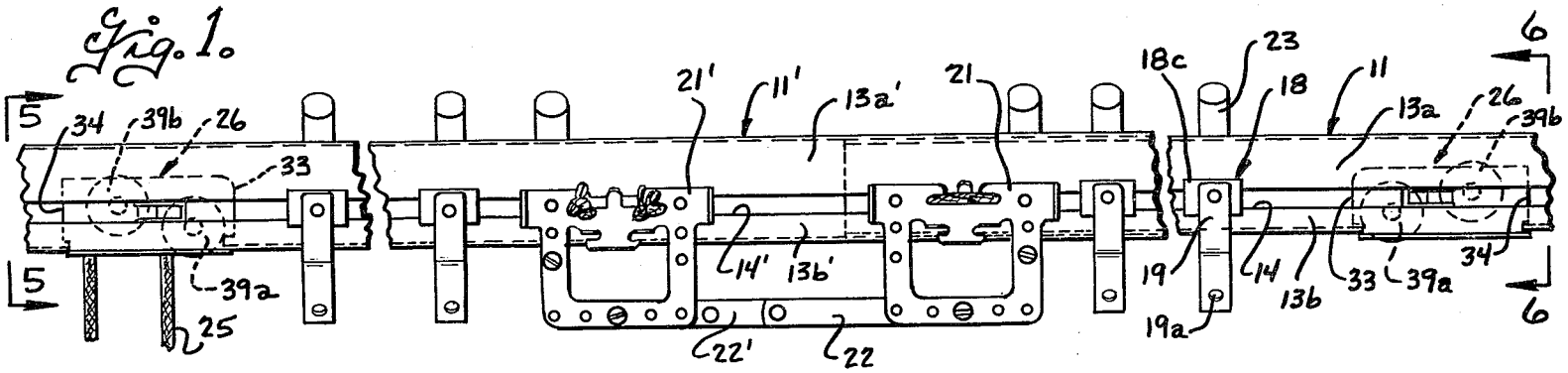
FIG. 1 is a fragmentary rear elevational view of a traverse rod and pulley housing assembly constructed in accordance with the present invention.

The traverse rod illustrated in FIG. 1 in general includes an elongated traverse rod having inner and outer tubular rod members 11 and 11' of like cross sectional configuration and with the inner rod member sufficiently smaller than the outer rod member to enable telescoping of the same. The rod members are formed of thin metal stock and like numerals followed by the postscript ' are used to designate parts of the outer rod member corresponding to those of the inner rod member. The rod members have a generally D-shaped cross section including face wall means 12, 12' of generally U-shaped cross section defining the top, front and bottom of the rod, and rear wall means 13, 13' at the rear of the rod member having upper and lower rear wall portions **13*a*, 13*b*, and 13*a'*, 13*b'* spaced apart to define a longitudinal slot 14, 14' extending lengthwise of each rod member. The face walls form the exposed surface of the rod members and, as is customary, are provided with a decorative finish. In the embodiment shown, the face walls are formed with a generally semi-cylindrical configuration and are longitudinal fluted, it being understood that the face walls could have a modified U-shaped cross section and may be plain or otherwise finished as desired. As disclosed more fully in U.S. Pat. No. 3,470,578, a mounting rail 13*c*, 13*c'*** may be formed at the upper rear portion of the rod member and adapted to interfit with mounting brackets (not shown) that support the rod member at locations adjacent its ends and also intermediate its ends.

Figure 4:
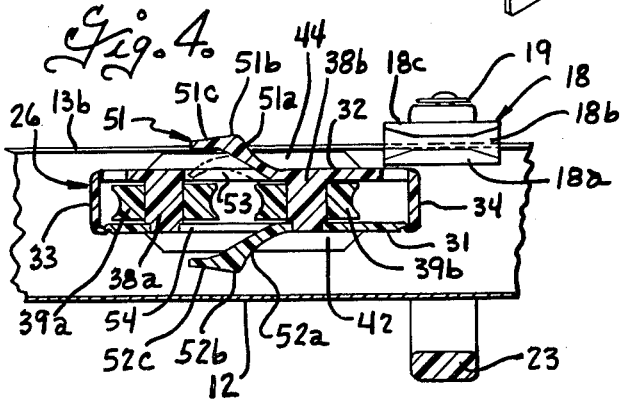
FIG. 4 is a fragmentary horizontal sectional view taken on the plane 4—4 of FIG. 2B.

A plurality of drapery carriers are mounted on the rod members for movement therealong and, as best shown in FIGS. 1 and 4, include slide bodies 18 having a head portion **18*a* disposed inside the rod, a neck portion 18*b* extending through the slot in the rear of the rod member, and a body portion 18*c* outside of the rod. Drapery support means such as pendants 19 are attached to the slide bodies and extend downwardly at the rear side of the rod and have means such as hook receiving openings 19*a* at the lower ends for receiving drapery support hooks to support a drapery on the carriers. The drapery carriers also include at least one and preferably two master carriers designated 21 and 21' which are slidably mounted by slide bodies of the type described at 18 above, and which have drapery support arms 22, 22' adapted to support the lead edge of a drapery. Decorative members 23** can be provided on the drapery carriers to simulate pole rings.

The master carriers 21, 21' are moved along the traverse rod by a traverse cord 25 and pulley housings 26 are provided adjacent the ends of the rod for guiding the traverse cords from within the rod to the exterior thereof at one end of the rod and for reversing the direction of the cord at the other end of the traverse rod. In accordance with one aspect of the present invention, the inner and outer rod members 11, 11' are provided with rod openings 27, 27' respectively in the face wall thereof adjacent the bottom of the rod members, and the pulley housings 26 are constructed and arranged so that they can be installed by insertion through the end of the respective rod member and then positioned with the lower portion of the pulley housing extending through the rod opening in the respective rod member. In accordance with another aspect of the present invention, the pulley housings 26 are constructed and arranged so that the same pulley housing can be used at either end of the rod and in both the inner and outer rod members.

Figure 2B:
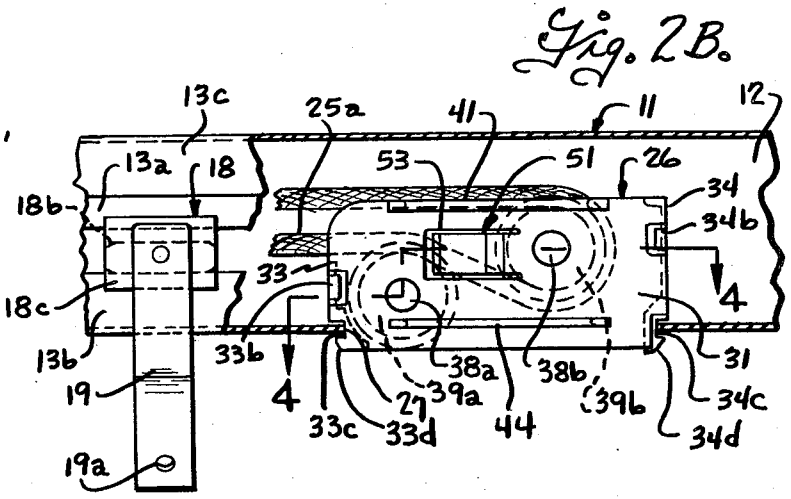
FIG. 2B is a fragmentary vertical sectional view through the traverse rod assembly illustrating the pulley housing installed in the other end of the traverse rod assembly.
Figure 2A:
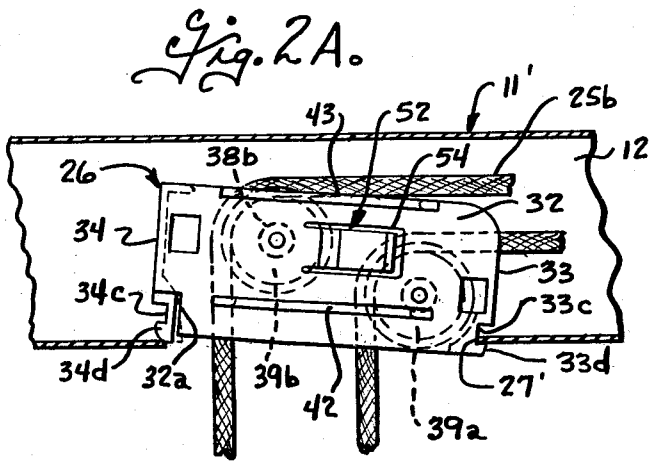
FIG. 2A is a fragmentary vertical sectional view through the traverse rod assembly illustrating installation of the pulley housing into one end of the traverse rod assembly.
Figure 3:
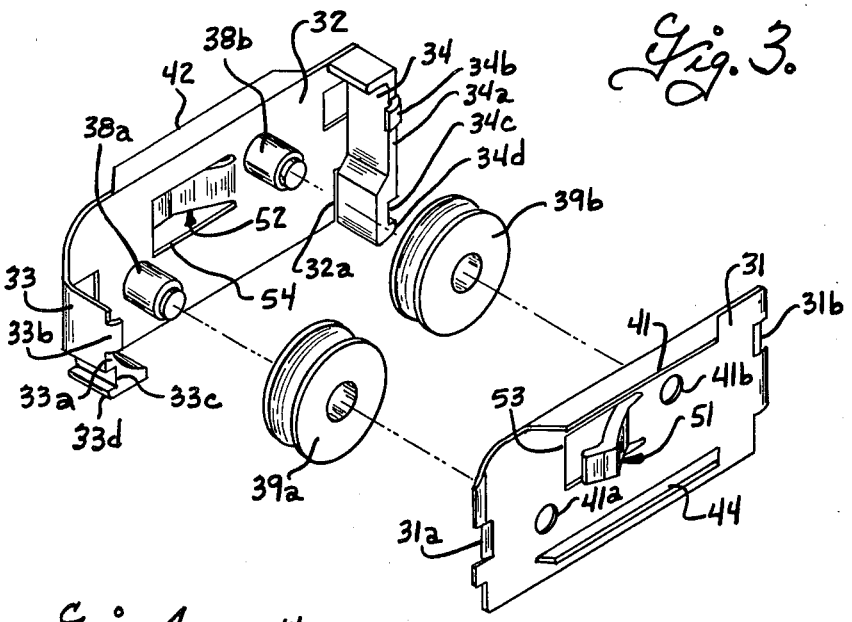
FIG. 3 is an exploded perspective view illustrating the pulley housing construction.

Referring now more specifically to FIGS. 3 and 4, the pulley housings 26 each include first and second spaced side walls 31 and 32, and first and second spaced end walls 33 and 34. The pulley housing is formed of plastic material and the end walls are conveniently formed integral with one of the side walls 32. The other side wall 31 is adapted to overlie the edges 33*a*, 34*a* of the end walls 33 and 34, and integral keepers 33*b* and 34*b* are provided on the end walls to engage and retain the side wall 31. The pulley housing is constructed and arranged so that the side wall 31 can be assembled on the end walls with a snap fit and for this purpose, the side wall 31 is formed with notches 31*a* and 31*b* for receiving the keepers 33*b* and 34*b* and the inner edges of the side wall 31 adjacent the notches 31*a* and 31*b* and the outer edges of the keepers 33*b* and 34*b* are rounded or beveled slightly to facilitate snapping of the side wall into position. Cord guides are provided between the side walls and, in the embodiment shown, trunnions 38*a* and 38*b* are molded integrally with one of the side walls 32 to rotatably receive cord guide pulleys 39*a* and 39*b*, and reduced end portions are provided on the trunnions to extend into openings 41*a* and 41*b* in the side wall 31. In order to avoid interference between the lengthwise extending runs of the cord in the rod, one of the trunnions 38*a* is disposed at a level below the level of the trunnion 38*b*. As shown in FIGS. 1 and 2, the traverse cord has lengthwise extending runs 25*a* and 25*b* that are looped over pulley 39*b* at one end of the rod and which pass downwardly over pulleys 39*a* and 39*b* at the other end of the rod. The runs 25*a* and 25*b* are connected intermediate their ends to master slides 21 and 21' to move them in relatively opposite directions.

In accordance with the present invention, the pulley housings have a height and width sufficiently smaller than the internal cross section of the inner rod member to enable endwise insertion of the pulley housing into the inner and outer rod members. The rod openings 27, 27' in the inner and outer rod members have a generally rectangular configuration and the lower portion of the pulley housings has a width and length to be receivable in the rod openings. In order to retain the pulley housings against upward displacement from the respective cord opening, a first housing retaining lip 33*d* is provided on the lower portion 33*c* of the first end wall and is adapted to underlie the underside of the face wall of the rod member at one end of the rod opening, and a second housing retaining lip 34*d* is provided on the lower portion 34*c* of the second housing end wall and is adapted to underlie the underside of the face wall of the rod member at the other end of the rod opening. As will be seen from FIG. 2B, the lower portions 33*c* and 34*c* of the end walls are adapted to engage the ends of the rod opening in the rod members to limit endwise movement of the pulley housings in the rod members, and the lips underlie the underside of the rod members to retain the pulley housings against upward movement. The lower portion 33*c* of the end wall 33 at the inner end of the rod opening is advantageously formed rigidly with the side wall 32 to provide a rigid abutment, and the lower portion 34*c* of the other end wall 34 is advantageously separated from the side wall 32, as by forming a slot 32*a* in the side wall at the juncture with the lower portion 34*c* of the end wall, so that the lower portion 34*c* is resiliently flexible as shown in FIG. 2A to allow the retaining lip 34*d* to snap over the other end of the rod opening, during installation of the pulley housing in the rod. The tensions in the draw cords during operation of the traverse rod, tend to move the pulley housings in a direction toward the center of the traverse rod and the pulley housing is positioned in both the inner and outer rod sections with its end wall 33 having the rigid lower portion 33*c* at the inner end of the rod opening while the end wall 34 having the resilient lower portion 34*c* is at the outer end of the rod opening. Thus, when the pulley housing 26 is positioned in the inner rod section, the first housing side wall 31 is adjacent the rear wall means 13 on the inner rod member 11 and, when the pulley housing 26 is positioned in the outer rod member, the second side wall 32 of the pulley housing is adjacent the rear wall means 13' of the outer rod member 11'.

Figure 5:
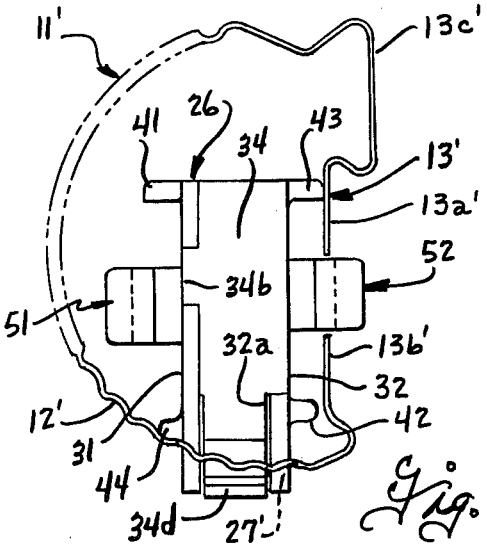
FIG. 5 is a fragmentary vertical sectional view taken on the plane 5—5 of FIG. 1 and showing the pulley housing installed in the outer rod member.
Figure 6:
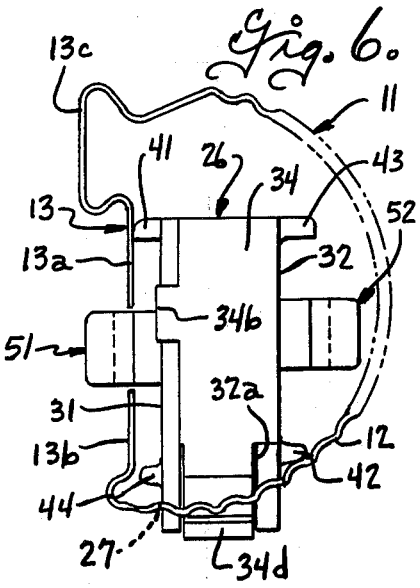
FIG. 6 is a fragmentary vertical sectional view taken on the plane 6—6 of FIG. 1 and showing the pulley housing installed in the inner rod member.

The pulley housings are positioned in the respective rod members so that the slides can move past the pulley housings to enable installation and removal of the slides from the traverse rod. As will be seen from FIGS. 5 and 6, the rod openings 27, 27' in the inner and outer rod members are spaced forwardly from the rear wall of the respective rod member a distance greater than the thickness of the head portion 18*a* of the slide bodies, so that, when the lower portion of the pulley housing is disposed in the respective rod opening, it is offset forwardly from the rear wall of the rod member. A first upper rib 41 is provided on the first housing side wall at a level to engage the upper rear wall portion 13*a* of the inner rod member to laterally space the upper portion of the pulley housing from the rear wall of the rod member, and a first lower rib 42 is provided on the second housing side wall 32 at a location spaced above its lower end to engage the inside of the face wall of the inner rod member adjacent the forward side of the rod opening, as shown in FIG. 6. The rib 42 on the second housing side wall 32 thus vertically positions the pulley housing in the inner rod member. A second upper rib 43 is provided on the second housing side wall 32 at a location to engage the upper rear wall portion 13*a'* of the outer rod member, to laterally space the pulley housing from the rear wall of the outer rod member, and a second lower rib 44 is provided on the first housing side wall 31 above its lower edge at a location to engage the inside of the face wall of the outer rod member adjacent the forward side of the rod opening, to vertically position the pulley housing in the outer rod member as shown in FIG. 5. As will be seen from FIGS. 5 and 6, the rib 42 on the second side wall 32 for vertically positioning the pulley housing in the inner rod member, is spaced above the lower end of the pulley housing a distance somewhat greater than the rib 44 for positioning the pulley housing in the outer rod member, to accommodate the relatively different size of the inner and outer rod members. Since the ribs 42 and 44 are located on the side walls of the pulley housing, they are not affected by the transverse curvature of the face wall of the rod members at the rod openings 27, 27'. Additionally, since the rib 42 which vertically supports the pulley housing in the inner rod member and the rib 44 that vertically supports the pulley housing in the outer rod member are located at the sides of the pulley housing remote from the rear wall of the respective rod member, the downward force on the pulley housing produced by pull on the draw cords, tends to cause the upper portion of the pulley housing to move toward the rear wall so that the spacing is controlled by the respective upper ribs 41 and 43.

A first carrier gate 51 is provided on the first side wall 31 to control movement of the carriers along the first rod member past the pulley housing, and a second carrier gate 52 is provided on the second side wall 32 to control movement of the carriers along the outer rod section past the pulley housing. As previously discussed, the pulley housing is formed of a resilient plastic material and the carrier gates 51 and 52 are advantageously formed integrally with the respective side walls 31 and 32. More particularly, the side walls 31 and 32 are formed with gate openings 53 and 54 respectively and the slide gates 51 and 52 are integrally joined at one end to the respective housing side wall. The slide gates are normally positioned in a carrier stop position with the free end of the slide gate offset outwardly from the respective side wall to extend into the path of movement of the carriers along the rod member as shown in FIG. 4, and the slide gates are yieldably movable inwardly as shown in phantom in FIG. 4 to a carrier by-pass position in which the free end of the gate is disposed in the gate opening in the side wall. The outer faces of the side gates 51 and 52 are respectively formed with a first ramp portion 51*a*, 52*a*, extending from the end of the gate that is integral with the side wall to a crest 51*b*, 52*b* intermediate the ends of the gate, and a second ramp portion 51*c*, 52*c* that extends from the crest to the free end of the gate. The first ramp portion diverges in a direction from its attached end toward the crest relative to the respective housing side wall, when the gate is in its carrier stop position, to provide a first cam surface that is engageable with the head portion of a drapery carrier to cam the gate toward its carrier by-pass position, when the carrier is moved from the end of the rod past the pulley housing. The second ramp portion 51*c*, 52*c* of the carrier gates 51, 52 are disposed in the slot in the respective rod member and the second ramp portion converges in a direction from the crest toward the free end of the slide gate relative to its housing side wall, when the gate is pressed inwardly to its carrier by-pass position shown in phantom in FIG. 4. Thus, each carrier gate can be manually pressed inwardly by applying pressure to the crest portion of the gate to position the free end portion of the gate in the gate opening in the side wall of the pulley housing, and a slide can then be moved to a position overlying the free end of the gate to hold the gate in its by-pass position, when manual pressure on the gate is removed. When the slide is then pushed toward the end of the rod, the slide will then further cam the gate inwardly to allow movement of the slide past the gate on the pulley housing. Thus, when adding slides to the rod, the slides can be moved along the rod past the pulley housing and will engage the first ramps 51*a*, 52*a* to cam the respective slide gate inwardly to allow the slide to move past the pulley housing. The slide gates will normally prevent movement of the slide in the other direction, but can be manually pressed inwardly by applying pressure to the crest 51*b*, 52*b* and then sliding the slide to a position in which it overlies the free end of the gate. The head on the slide will then engage the ramp 51*c*, 52*c* to further cam the gate inwardly and allow movement of the slide past the pulley housing and out of the rod.

The rod members are formed of a relatively thin and deformable sheet material and, when end finials (not shown) are applied to the ends of the rods, the rods are sometimes deformed in a manner to partially close the slot at the rear of the rod and inhibit movement of the slides along the rod near the ends of the traverse rod. Such end finials commonly have a sleeve portion which is adapted to receive the end of the rod member, and they tend to constrict the rod member. In order to inhibit deformation of the rod which could interfere with movement of the carriers along the slot, the gates 51 and 52 are advantageously formed with a vertical height slightly greater than the corresponding vertical depth of the neck portion 18*b* of the slides. As previously pointed out, the gates extend into the slot and, if the end finials tend to radially compress the ends of the rod, the gates will maintain a minimum slot width sufficient to allow free movement of the slides along the rod members.

From the foregoing it is thought that the construction and operation of the traverse rod and pulley housing assembly will be readily understood. The same pulley housing 26 can be used in either end of the rod and in both the inner and outer rod sections. When positioned in the inner rod section one side wall 31 is adjacent the rear wall of the inner rod section and when positioned in the outer rod section, the other side wall 32 is adjacent the rear wall of the outer rod section. The pulley housings are installed by insertion into the ends of the rod and then positioning the pulley housing so that the lower portion extends through the rod opening in the lower part of the face wall of the rod. When installed in the inner rod member, the pulley housing is laterally positioned by the upper rib 41 on the first side wall and vertically positioned by the lower rib 42 on the second side wall, and when the pulley housing is installed in the outer rod member, it is laterally positioned by the upper rib 43 on the second side wall and by the lower rib portion 44 on the first side wall. This arrangement allows proper positioning of the pulley housings in the inner and outer rod members, while accommodating the relatively different size of the inner and outer rod members. Dual slide gates are provided, one on ech side wall of the pulley housing, with one gate 51 being operative to control movement of the slides past the housing in the inner rod member and the other gate 52 being operative to control movement of the slides past the pulley housing in the outer rod member.

The embodiments of the invention in which an exclusive property or privilege is claimed are defined as follows:

1. In a traverse rod assembly including inner and outer telescoping tubular rod members of generally D-shaped cross section, each rod member having face wall means of generally U-shaped cross section defining the top, front and bottom of the rod and rear wall means at the rear of the rod member having upper and lower rear wall portions spaced apart to define a longitudinal slot extending lengthwise of the rod member, the inner and outer rod members each having a generally rectangular rod opening through its face wall at the bottom of the rod member and spaced forwardly from its lower rear wall portion, a plurality of drapery carriers each having a head portion inside a rod member and a neck portion in the slot and means outside the rod members for attaching a drapery thereto, a pair of pulley housings of like construction each including first and second spaced housing sidewalls and first and second housing end walls extending between the housing side walls and cord guide means disposed between the housing side walls, the pulley housings being adapted for insertion into the ends of the inner and outer rod members with their first housing end walls innermost and with the first housing side wall of the pulley housing in the inner rod member juxtaposed to the rear wall means of the inner rod member and with the second housing side wall of the pulley housing in the outer rod member juxtaposed to the rear wall means of the outer rod member, the pulley housings each having lower portions dimensioned to pass downwardly through the rod opening in the respective rod member, each pulley housing having a first housing retaining lip projecting from the lower portion of its first end wall adapted to underlie the underside of the face wall of the rod member at the one end of the rod opening and a second housing retaining lip projecting from the lower portion of its second end wall adapted to underlie the underside of the face wall of the rod member at the other end of the rod opening, one of said retaining lips being resiliently movable relative to the pulley housing to snap over the end of the rod opening and allow the lower portion of the pulley housing to move into the rod opening, and each pulley housing having means thereon engageable with the inner side of the rod members for positioning the pulley housings therein.

2. In a traverse rod assembly according to claim 1 wherein the second retainer lip on the second end wall of the pulley housing is resiliently movable relative to the pulley housing.

3. In a traverse rod assembly according to claim 1 including a first slide gate on said first housing side wall for controlling movement of the drapery carriers along the slot in the inner rod member and a second slide gate on a second housing side wall for controlling movement of drapery carriers along the slot in the outer rod member.

4. In a traverse rod according to claim 1 wherein each housing side wall has a gate opening therein and a slide gate integrally joined at one end to the housing side wall at one end of the gate opening, the housing side walls being formed of a resilient material and the slide gates being resiliently movable relative to their respective housing side wall from a position in which the free end of the slide gate is offset outwardly from the housing side wall to a position in which its free end is disposed in the gate opening.

5. In a traverse rod assembly including inner and outer telescoping tubular rod members of generally D-shaped cross section, each rod member having face wall means of generally U-shaped cross section defining the top, front and bottom of the rod and rear wall means at the rear of the rod member having upper and lower rear wall portions spaced apart to define a longitudinal slot extending lengthwise of the rod member, the inner and outer rod members each having a generally rectangular rod opening through its face wall at the bottom of the rod member and spaced forwardly from its lower rear wall portion, a plurality of drapery carriers each having a head portion inside a rod member and a neck portion in the slot and means outside the rod members for attaching a drapery thereto, a pair of pulley housings of like construction each including first and second spaced housing sidewalls and first and second housing end walls extending between the housing side walls and cord guide means disposed between the housing side walls, the pulley housings being adapted for insertion into the ends of the inner and outer rod members with their first housing end walls innermost and with the first housing side wall of the pulley housing in the inner rod member juxtaposed to the rear wall means of the inner rod member and with the second housing side wall of the pulley housing in the outer rod member juxtaposed to the rear wall means of the outer rod member, the pulley housings each having lower portions dimensioned to pass downwardly through the rod opening in the respective rod member, each pulley housing having a first housing retaining lip projecting from the lower portion of its first end wall adapted to underlie the underside of the face wall of the rod member at the one end of the rod opening and a second housing retaining lip projecting from the lower portion of its second end wall adapted to underlie the underside of the face wall of the rod member at the other end of the rod opening, one of said retaining lips being resiliently movable relative to the pulley housing to snap over the end of the rod opening and allow the lower portion of the pulley housing to move into the rod opening, and each pulley housing having means thereon engageable with the inner side of the rod members for positioning the pulley housings therein, a first slide gate on said first housing side wall for controlling movement of the drapery carriers along the slot in the inner rod member and a second slide gate on a second housing side wall for controlling movement of drapery carriers along the slot in the outer rod member, said means for positioning the pulley housing including:

(a) a first upper rib on the first housing side wall adapted for engagement with the upper rear wall portion of the inner rod member to laterally position the pulley housing;

(b) a first lower rib on the second housing side wall adapted for engagement with the inside of the face wall of the inner rod member adjacent the forward side of the rod opening therein to vertically position the pulley housing in the inner rod member such that the first slide gate is adjacent the slot;

(c) a second upper rib on the second housing side wall adapted for engagement with the upper rear wall portion of the outer rod member to laterally position the pulley housing; and (d) a second upper rib on the first housing side wall adapted for engagement with the inside of the face wall of the outer rod member adjacent the forward side of the rod opening therein to vertically position the pulley housing in the outer rod member such that the second slide gate is adjacent the slot.

6. In a traverse rod assembly according to claim 5 wherein each slide gate has a portion thereof adapted to extend through the slot in the respective rod member.

7. In a traverse rod assembly according to claim 5 wherein each slide gate has a portion thereof which is normally positioned in the slot to block movement of slides therealong, the slide gates being movable relative to the respective pulley housing out of the slot to allow movement of drapery carriers therealong.

8. In a traverse rod assembly according to claim 7 wherein the portion of the slide gate that is normally positioned in the slot has a vertical dimension greater than the corresponding vertical dimension of the neck of the drapery carrier.

9. In a traverse rod assembly including inner and outer telescoping tubular rod members of generally D-shaped cross section, each rod member having face wall means of generally U-shaped cross section defining the top, front and bottom of the rod and rear wall means at the rear of the rod member having upper and lower rear wall portions spaced apart to define a longitudinal slot extending lengthwise of the rod member, the inner and outer rod members each having a generally rectangular rod opening through its face wall at the bottom of the rod member and spaced forwardly from its lower rear wall portion, a plurality of drapery carriers each having a head portion inside a rod member and a neck portion in the slot and means outside the rod members for attaching a drapery thereto, a pair of pulley housings of like construction each including first and second spaced housing sidewalls and first and second housing end walls extending between the housing side walls and cord guide means disposed between the housing side walls, the pulley housings being adapted for insertion into the ends of the inner and outer rod members with their first housing end walls innermost and with the first housing side wall of the pulley housing in the inner rod member juxtaposed to the rear wall means of the inner rod member and with the second housing side wall of the pulley housing in the outer rod member juxtaposed to the rear wall means of the outer rod member, the pulley housings each having lower portions dimensioned to pass downwardly through the rod opening in the respective rod member, each pulley housing having a first housing retaining lip projecting from the lower portion of its first end wall adapted to underlie the underside of the face wall of the rod member at the one end of the rod opening and a second housing retaining lip projecting from the lower portion of its second end wall adapted to underlie the underside of the face wall of the rod member at the other end of the rod opening, one of said retaining lips being resiliently movable relative to the pulley housing to snap over the end of the rod opening and allow the lower portion of the pulley housing to move into the rod opening, and each pulley housing having means thereon engageable with the inner side of the rod members for positioning the pulley housings therein, said means on the pulley housing for positioning the pulley housings including:

(a) a first upper rib on the first housing side wall adapted for engagement with the upper rear wall portion of the inner rod member to laterally position the pulley housing;

(b) a first lower rib on the second housing side wall above its lower edge adapted for engagement with inside of the face wall of the inner rod member adjacent the forward side of the rod opening therein to vertically position the pulley housing;

(c) a second upper rib on the second housing side wall adapted for engagement with the upper rear wall portion of the outer rod member to laterally position the pulley housing; and (d) a second lower rib on the first housing side wall above its lower edge adapted for engagement with the inside of the face wall of the outer rod member adjacent the forward side of the rod opening therein to vertically position the pulley housing.

10. In a traverse rod assembly including inner and outer telescoping tubular rod members of generally D-shaped cross section, each rod member having face wall means of generally U-shaped cross section defining the top, front and bottom of the rod and rear wall means at the rear of the rod member having upper and lower rear wall portions spaced apart to define a longitudinal slot extending lengthwise of the rod member, the inner and outer rod members each having a generally rectangular rod opening through its face wall at the bottom of the rod member and spaced forwardly from its lower rear wall portion, a plurality of drapery carriers each having a head portion inside a rod member and a neck portion in the slot and means outside the rod members for attaching a drapery thereto, a pair of pulley housings of like construction each including first and second spaced housing side walls and first and second housing ends and cord guide means disposed between the housing side walls, the pulley housings being adapted for insertion into the ends of the inner and outer rod members with their first housing ends innermost and with the first housing side wall of the pulley housing in the inner rod member juxtaposed to the rear wall means of the inner rod member and with the second housing side wall of the pulley housing in the outer rod member juxtaposed to the rear wall means of the outer rod member, the pulley housings each having lower portions dimensioned to pass downwardly through the rod opening in the respective rod member, a first slide gate on said first housing side wall for controlling movement of the drapery carriers along the slot in the inner rod member and a second slide gate on a second housing side wall for controlling movement of drapery carriers along the slot in the outer rod member, and means for positioning the pulley housings in the respective rod members, including:

(a) a first upper rib on the first housing side wall adapted for engagement with the upper rear wall portion of the inner rod member to laterally position the pulley housing in the inner rod member;

(b) a first lower rib on the second housing side wall adapted for engagement with the inside of the face wall of the inner rod member adjacent the forward side of the rod opening therein to vertically position the pulley housing in the inner rod member such that the first slide gate is adjacent the slot;

(c) a second upper rib on the second housing side wall adapted for engagement with the upper rear wall portion of the outer rod member to laterally position the pulley housing in the outer rod member; and (d) a second upper rib on the first housing side wall adapted for engagement with the inside of the face wall of the outer rod member adjacent the forward side of the rod opening therein to vertically position the pulley housing in the outer rod member such that the second slide gate is adjacent the slot.

11. In a traverse rod assembly according to claim 10 wherein each slide gate has a portion thereof which is normally positioned in the slot to block movement of slides therealong, the slide gates being movable relative to the respective pulley housing out of the slot to allow movement of drapery carriers therealong.

12. In a traverse rod assembly according to claim 11 wherein the portion of the slide gate that is normally positioned in the slot has a vertical dimension greater than the corresponding vertical dimension of the neck of the drapery carrier.

13. In a traverse rod according to claim 10 wherein each housing side wall has a gate opening therein and a slide gate integrally joined at one end to the housing side wall at one end of the gate opening, the housing side walls being formed of a resilient material and the slide gates being resiliently movable relative to their respective housing side wall from a position in which the free end of the slide gate is offset outwardly from the housing side wall to a position in which its free end is disposed in the gate opening.

14. In a traverse rod assembly including inner and outer telescoping tubular rod members of generally D-shaped cross section, each rod member having face wall means of generally U-shaped cross section defining the top, front and bottom of the rod and rear wall means at the rear of the rod member having upper and lower rear wall portions spaced apart to define a longitudinal slot extending lengthwise of the rod member, the inner and outer rod members each having a generally rectangular rod opening through its face wall at the bottom of the rod member and spaced forwardly from its lower rear wall portion, a plurality of drapery carriers each having a head portion inside a rod member and a neck portion in the slot and means outside the rod members for attaching a drapery thereto, a pulley housing formed of resilient plastic material and including first and second spaced housing side walls and first and second housing end walls extending between the housing side walls and cord guide means disposed between the housing side walls, the pulley housing being adapted for insertion into the end of one of the rod members, means on the pulley housing for engaging the walls of the rod member to position the pulley housing therein, with one side wall spaced laterally inwardly from the rear wall means a distance sufficient to pass the head portion of a drapery carrier, said one side wall of the pulley housing having a gate opening therethrough at a location intermediate the first and second housing end walls and a slide gate integrally joined at one end to said one housing side wall at one end of the gate opening, said slide gate being resiliently movable relative to said one housing side wall from a carrier stop position in which the free end of the gate is offset outwardly of said one housing side wall to a carrier by-pass position in which its free end is disposed in the gate opening.

15. In a traverse rod assembly according to claim 14 wherein the outer face of said slide gate has a first ramp portion extending from said one end thereof to a crest intermediate its ends and a second ramp portion extending from the crest to the free end of the slide gate, said first ramp portion diverging in a direction from said one end of the gate to said crest relative to said one housing side wall when the slide gate is in its carrier stop position to provide a first cam surface engageable with the head portion of a drapery carrier to cam the slide gate towards its carrier by-pass position when the drapery carrier is moved in one direction along the slot, said second ramp portion being disposed in said slot when said slide gate is in its carrier stop position and the second ramp portion converging in a direction from said crest toward the free end of the slide gate relative to said one housing side wall when the slide gate is in its carrier by-pass position with the free end of the gate disposed in the gate opening to provide a second cam surface engageable with the head on a drapery carrier to hold the slide gate in its by-pass position when a drapery carrier is moved along the slot in the other direction past the slide gate.

16. In a traverse rod assembly including a rod member of generally D-shaped cross section having face wall means of generally U-shaped cross section defining the top, front and bottom of the rod member and rear wall means at the rear of the rod member having upper and lower rear wall portions spaced apart to define a longitudinal slot extending lengthwise of the rod member, the rod member having a rod opening through the face wall at the bottom of the rod and spaced forwardly from the rear wall means, a plurality of drapery carriers each having a head portion inside the rod member, a neck portion in the slot and means inside the rod members for attaching a drapery thereto, a pulley housing including first and second side walls and cord guide means between the side walls, the pulley housing being adapted for insertion into the end of the rod member with one side wall juxtaposed to the rear wall means and the first and second side walls having a lower portion dimensioned to pass downwardly through the rod opening in the rod member, a first rib on the upper portion of said one side wall at a location to engage the upper rear wall portion of the rear wall means above the slot to space said one side wall of the pulley housing laterally from the rear wall means, a second rib on the other side wall at a location above its lower edge adapted for engagement with the inside of the face wall of the rod member adjacent the forward edge of the rod opening therein to vertically position the pulley housing in the rod member, said one housing side wall having a gate opening therethrough at a location intermediate the ends of the pulley housing and a slide gate integrally joined at one end to said one housing side wall at one end of the gate opening, the pulley housing being formed of a resilient material and the slide gate being resiliently movable relative to said one housing side wall from a position in which the free end of the slide gate is offset outwardly from the said one housing side wall to a position in which its free end is disposed in said gate opening.

* * * * *